US009508333B2

(12) United States Patent
Gillette

(10) Patent No.: US 9,508,333 B2
(45) Date of Patent: Nov. 29, 2016

(54) MAGNETOELECTRIC PICKUP ELEMENT FOR DETECTING OSCILLATING MAGNETIC FIELDS

(71) Applicant: Northeastern University, Boston, MA (US)

(72) Inventor: Scott M. Gillette, Norfolk, MA (US)

(73) Assignee: Northeastern University, Boston, MA (US)

( * ) Notice: Subject to any disclaimer, the term of this patent is extended or adjusted under 35 U.S.C. 154(b) by 0 days.

(21) Appl. No.: 14/761,128

(22) PCT Filed: Jan. 17, 2014

(86) PCT No.: PCT/US2014/012082
§ 371 (c)(1),
(2) Date: Jul. 15, 2015

(87) PCT Pub. No.: WO2014/113694
PCT Pub. Date: Jul. 24, 2014

(65) Prior Publication Data

US 2015/0371623 A1 Dec. 24, 2015

Related U.S. Application Data

(60) Provisional application No. 61/753,601, filed on Jan. 17, 2013.

(51) Int. Cl.
*G10H 3/18* (2006.01)

(52) U.S. Cl.
CPC ..... *G10H 3/18* (2013.01); *G10H 3/181* (2013.01); *G10H 2220/521* (2013.01)

(58) Field of Classification Search
CPC ..... G10H 3/00; G10H 3/12; G10H 3/14; G10H 3/18; G10H 3/181; G10H 2220/521
USPC ..... 84/723, 725, 726, 730, 731, 743
See application file for complete search history.

(56) References Cited

U.S. PATENT DOCUMENTS 2,506,393 A * 5/1950 Smoluchowski ..... C22F 1/10 148/120
2001/0028245 A1* 10/2001 Li ..... G01R 33/18 324/312
2004/0126620 A1* 7/2004 Viehland ..... H01L 41/00 360/328

(Continued)

FOREIGN PATENT DOCUMENTS

GB 2188157 A 9/1987

OTHER PUBLICATIONS

S. Dong, et al., "Extremely low frequency response of magnetoelectric multilayer composites", Applied Physics Letters, vol. 86, 2005, pp. 102901-1-102901-3.

(Continued)

*Primary Examiner* — Jeffrey Donels
(74) *Attorney, Agent, or Firm* — Posternak Blankstein & Lund LLP

(57) ABSTRACT

A magnetoelectric pickup device for use with a stringed musical instrument combines magnetostriction and the piezoelectric effect to detect a combination of magnetic field oscillations produced by a vibrating ferromagnetic string and acoustic vibrations from the body of the instrument itself. The result is a sound reproduction that preserves the natural acoustic timbre of the instrument.

23 Claims, 8 Drawing Sheets

(56) References Cited

U.S. PATENT DOCUMENTS

| | | | | |
|---|---|---|---|---|
| 2008/0269963 | A1* | 10/2008 | Vos | G01C 21/165 701/4 |
| 2010/0005954 | A1* | 1/2010 | Higashidate | G10H 3/143 84/725 |
| 2011/0001397 | A1* | 1/2011 | Tucker | H01L 41/16 310/339 |

OTHER PUBLICATIONS

J. Ma, et al., "Recent Progress in Multiferroic Magnetoelectric Composites: from Bulk to Thin Films", Advanced Materials, vol. 23, 2011, pp. 1062-1087.

C.-W. Nan, et al, "Multiferroic magnetoelectric composites: Historical perspective, status, and future directions", Journal of Applied Physics, vol. 103, 2008, pp. 031101-1-031101-35.

G. Srinivasan, "Magnetoelectric Composites", Annual Review of Materials Research, vol. 40, 2010, pp. 153-178.

Y. Wang, et al, "Multiferroic magnetoelectric composite nanostructures", NPG Asia Materials, vol. 2, No. 2, 2010, pp. 61-68.

J. Zhai, et al., "Magnetoelectric Laminate Composites: An Overview", Journal of the American Ceramic Society, vol. 91, No. 2, 2008, pp. 351-358.

S. M. Gillette, et al., "Improved Sensitivity and Noise in Magneto-Electric Magnetic Field Sensors by Use of Modulated AC Magnetorestriction", IEEE Magnetics Letters, vol. 2, 2500104, 2011, 4 pgs.

Y. Chen, et al., "Quasi-one-dimensional miniature multiferroic magnetic field sensor with high sensitivity at zero bias field", Applied Physics Letters, vol. 99, 2011, pp. 042505-1-042505-3.

M. Fiebig, "Revival of the magnetoelectric effect", Journal of Physics D: Applied Physics, vol. 38, 2005, pp. R123-R152.

M. Li, et al., "Enhanced Sensitivity and Reduced Noise Floor in Magnetoelectric Laminate Sensors by an Improved Lamination Process", Journal of the American Ceramic Society, vol. 94, No. 11, 2011, pp. 3738-3741.

* cited by examiner

MAGNETOELECTRIC PICKUP ELEMENT FOR DETECTING OSCILLATING MAGNETIC FIELDS

CROSS-REFERENCE TO RELATED APPLICATIONS

This application claims the priority of U.S. Provisional Application No. 61/753,601, filed Jan. 17, 2013, entitled "MAGNETOELECTRIC PICKUP ELEMENT FOR DETECTING OSCILLATING MAGNETIC FIELDS", which is hereby incorporated by reference in its entirety.

BACKGROUND

Engineered magnetoelectric (ME) composites with increased coupling efficiency between the constituent materials have led to the development of sensitive, low-noise, ME magnetic field sensors, and conversely, to the development also of voltage driven magnetic field generators. (Fiebig, 2005; Spaldin and Fiebig, 2005; Lenz and Edelstein, 2006; Chen et al., 2010; Geiler et al., 2010; Fitchorov, T., Chen, Y. et al., 2011, and Fitchorov, T., Yajie, C. et al., 2011). An ideal ME device would require no external power supply and no external conditioning circuitry, would exhibit stable room-temperature operation, and would be relatively inexpensive to fabricate. Current generation ME devices exhibit several of these characteristics and, as such, have tremendous potential to compete with existing flux-gate, Hall-effect, SQUID (superconducting quantum interference device), and magnetoresistive magnetometers in a variety of applications.

Numerous geometries and topologies of ME composites have been investigated, such as bulk heterostructural laminates, thick- and thin-film devices, and more recently a quasi-one dimensional tube topology (Ma et al., 2011; Chen et al., 2011). The ME phenomenon occurs in these composites via transfer of stress energy between magnetostrictive and piezoelectric phases. Due to the nature of stress-coupled magnetization in a magnetostrictive material, and stress-coupled polarization in a piezoelectric material, elastically-bonded composites having both materials have the ability to transduce a voltage response from an applied magnetic field and vice-versa (Nan et al., 2008).

Among the various parameters of ME composite devices under investigation, e.g., topology, bonding, amplification, and sensing techniques, the magnetostrictive and piezoelectric materials used in fabrication are of particular importance (Li et al., 2011; Gillette et al., 2011; and Dong et al., 2005). Typically, piezoelectric materials, exhibiting high piezoelectric constants, such as PZT (lead zirconte titanate) and PMN-PT (magnesium lead niobium, and lead titanium), are desirable for generating large strain-induced charge separation. However, in a magnetostrictive material, a large value of saturation magnetostriction alone does not always make it an optimal material choice. Other factors such as magnetization process, magnetic hysteresis, and magnetic anisotropy also play an important role. Further, the slope of the magnetostriction curve ($d\lambda/dH$) has a significant influence on ME coupling. The sensitivity of ME magnetic field sensors can be increased by applying an optimal external DC magnetic bias field. Peak magnetoelectric sensitivity typically occurs when the magnitude of the external magnetic bias field corresponds with the peak of the derivative of the magnetostriction curve, a maximum in $d\lambda/dH$, but can be offset due to factors such as magnetic hysteresis, shape anisotropy, and demagnetization. Optimal external magnetic bias field magnitude can range from tens to thousands of oersted (Oe), requiring the use of bulky permanent magnets or electromagnets.

Advances in ME composite materials offer opportunities for developing miniature, lightweight, highly-sensitive, low-noise ME magnetic field sensors that require little to no external magnetic bias for deployment in various magnetometry applications.

SUMMARY OF THE INVENTION

The magnetoelectric pickup device of the present invention is adapted for use with a stringed musical instrument, and uses combined magnetostriction and the piezoelectric effect to detect a combination of the oscillating magnetic field produced by a vibrating ferromagnetic string and mechanical (i.e., acoustic) vibrations from the body of the instrument itself. The pickup device is highly sensitive, does not require any internal power, and combines and reproduces the harmonics of the string with the harmonics of the instrument body to create a unique sound blend that is amplifiable and capable of digital editing without intervention of a microphone. The result is a novel and much richer sound reproduction that preserves more of the natural, unamplified acoustic timbre of the instrument than has been obtainable before.

One aspect of the invention is a magnetoelectric pickup for a musical string instrument. The pickup includes a manetoelectric sensor and a pickup mount. The sensor includes an inner electrode core comprising or consisting or a magnetostrictive material, a piezoelectric coating material surrounding the inner electrode core at least in part, and an outer electrode layer applied to an outer surface of the piezoelectric coating material comprising of either a conductive material or a conductive magnetostrictive material. The piezoelectric coating material is elastically bonded to the inner electrode core. The pickup mount contains mounted within it or mounted on its surface the magnetoelectric sensor, and is adapted to mount on the body of the musical string instrument. Either an oscillating magnetic field or an acoustic vibration, or both, in the vicinity of the pickup element produces a voltage output signal between said inner and outer electrodes.

In embodiments of the pickup, the inner electrode core comprises a magnetostrictive material selected from the group consisting of: iron-nickel alloys, iron-cobalt-vanadium alloys, galfenol, amporphous magnetic glass material, and combinations thereof. In embodiments, magnetostrictive material is galfenol, and the sensitivity at an external bias of 50 Oe is at least about 3.5 mV/Oe, at least about 4.5 mV/Oe, at least about 5.5 mV/Oe, or at least about 6.25 mV/Oe. In embodiments, the magnetostrictive material is galfenol, and the sensitivity at zero external bias is Oe is at least about 0.4 mV/Oe, at least about 0.5 mV/Oe, at least about 0.6 mV/Oe, at least about 0.7 mV/Oe, or at least about 0.8 mV/Oe. In embodiments, the magnetostrictive material is iron-cobalt-vanadium alloy, and the sensitivity at 15 Oe is at least about 1.0 mV/Oe, at least about 1.5 mV/Oe, or at least about 2.0 mV/Oe. In embodiments, the magnetostrictive material is iron-cobalt-vanadium alloy, and the sensitivity at zero external bias is Oe is at least about 0.4 mV/Oe, at least about 0.8 mV/Oe, or least about 1.12 mV/Oe. In embodiments, the magnetostrictive material is iron-nickel, and the sensitivity at 10 Oe is, at least about 2.5 mV/Oe, at least about 0.3 mV/Oe, at least about 0.4 mV/Oe, or at least about 5.0 mV/Oe. In embodiments, the magnetostrictive material is iron-nickel, and the sensitivity at zero external bias is Oe is at least about 1.5 mV/Oe, at least about 2.0 mV/Oe, at least about 2.5 mV/Oe, or at least about 3.0 mV/Oe.

In other embodiments of the pickup, the piezoelectric coating material comprises or consists of lead zirconate titanate and the outer electrode layer comprises or consists of Ag. In embodiments the outer electrode layer comprises at least one strip of a ferromagnetic amorphous metal alloy, such as an amorphous magnetic glass. In certain embodiments, two or more strips of the ferromagnetic amorphous metal alloy are uniformly spaced. In embodiments, the at least one strip of the ferromagnetic amorphous metal alloy is sinter-bonded to the tube's exterior using a silver conductive epoxy. In embodiments, the outer electrode layer is a conductive magnetostrictive jacket that serves both as outer electrode and as a uniform outer magnetic strain source.

In other embodiments of the pickup, the zero-biased sensitivity is at least about 4.0 mV/Oe, or at least about 5.0 mV/Oe, or at least about 6.0 mV/Oe, or at least about 7.4 mV/Oe. In embodiments, the 7.5 Oe biased sensitivity is at least about 7.0 mV/Oe, or at least about 8.0 mV/Oe, or at least about 9.0 mV/Oe, or at least about 10.0 mV/Oe, or at least about 11.0 mV/Oe, or at least about 112.0 mV/Oe.

In certain embodiments of the pickup, the pickup is cylindrical in form. In embodiments, the pickup is smaller than a conventional electromagnetic pickup, such as less than 1 mm in diameter, or less than 0.5 mm in diameter.

Another aspect of the invention is a musical string instrument containing any embodiment of the magnetoelectric pickup described above. In embodiments of the instrument, the instrument is selected from the group consisting of guitars. banjos, mandolins, ukeleles, pianos, harpsichords, violins, violas, cellos, and double basses. In embodiments, the pickup is mounted on the soundboard of the instrument beneath the strings.

Another aspect of the invention is a method of detecting acoustic vibrations in a musical string instrument. The method includes detecting charge separation between the inner and outer electrodes of the magnetoelectric pickup of any of the preceding embodiments. In embodiments of the method, a voltage output signal from the magnetoelectric pickup replicates both a vibration emanating from a string of the instrument and an acoustic vibration emanating from a portion of the body of the instrument.

Yet another aspect of the invention is a method of fabricating a musical instrument. The method includes incorporating one or more magnetoelectric pickups described above into a musical instrument. In an embodiment of the method, a magnetoelectric sensor is mounted in a pickup mount.

Still another aspect of the invention is a magnetoelectric sensor device configured for detecting magnetic oscillations and acoustic vibrations as part of a gradiometric magnetometric array. The element includes: an inner electrode core containing a magnetostrictive material; a piezoelectric coating material surrounding the inner electrode core at least in part; and an outer electrode layer applied to an outer surface of the piezoelectric coating material. The piezoelectric coating material is elastically bonded to the inner electrode core, and the device is assembled into the gradiometric magnetometric array. An oscillating magnetic field, or acoustic vibrations in the vicinity of the gradiometric magnetometric array, causes strain within the core, and causes charge separation between the inner electrode core and the outer electrode layer. In an embodiment the magnetoelectric sensor device just described is used in an unmanned airborne vehicle gradiometric magnetometric array.

BRIEF DESCRIPTION OF THE DRAWINGS

FIG. 8A shows full bipolar-H sweeps, and FIG. 8B shows peak sensitivity plots.

DETAILED DESCRIPTION OF THE INVENTION

Figure 1A:
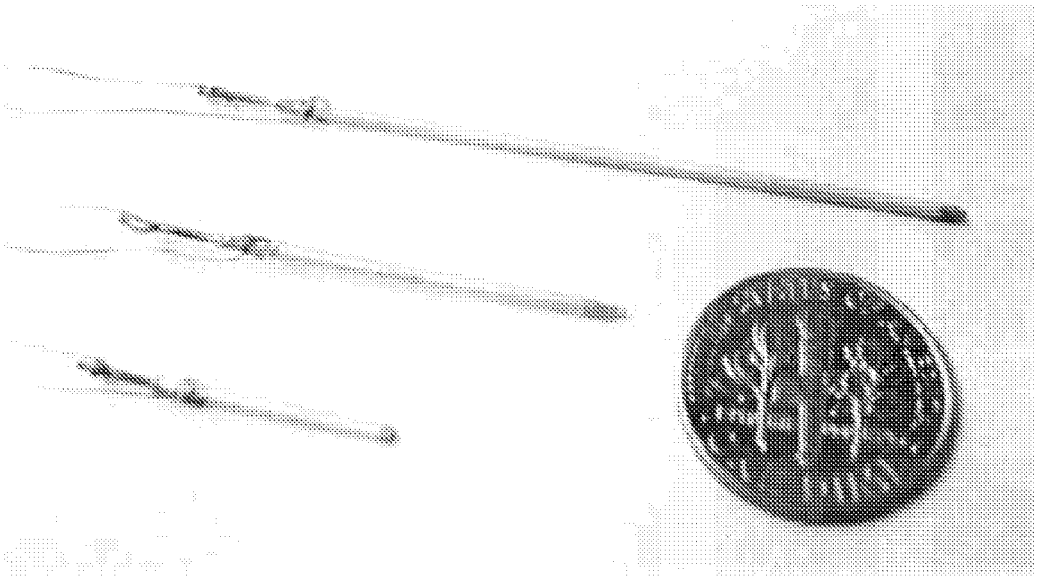
FIG. 1A PRIOR ART
FIG. 1A is a photograph showing prior art magnetoelectric pickup devices of three different lengths (5 cm, 2.5 cm, and 1.5 cm) (Chen et al., 2011).

A magnetoelectric (ME) pickup device for stringed instruments is provided. The magnetoelectric pickup device simultaneously senses oscillating magnetic fields from the vibrating strings of the instrument and acoustic vibrations from the body of the instrument, such as from the hollow or solid wooden body or soundboard of an acoustic stringed instrument. The ME device outputs a single electrical response (e.g., a change in output voltage across the two leads of each ME sensor) proportional to both acoustic and magnetic inputs. Oscillating magnetic fields are detected using a magnetostrictive material which is capable of structurally deforming in response to the field oscillations. The magnetostrictive material in turn generates strain in response to the magnetic perturbation, and this strain response is elastically coupled to a piezoelectric element which surrounds the core magnetostrictive material. The piezoelectric element then generates a voltage response which is proportional to the strain. Similarly, acoustic vibrations (mechanical perturbations) applied to the piezoelectric material, preferably through a pickup mount contacting the body or soundboard of the instrument, cause the ME device to output a voltage response that is proportional to the strain and therefore mimics the pattern of vibrations. Unlike previous pickup devices that operate purely by detecting vibration using an electromagnet, the magnetoelectric pickup device of the present invention combines a direct tonal response generated by a vibrating ferromagnetic wire with natural acoustic reverberations occurring in the materials of the instrument. The result is a novel and much richer sound reproduction that preserves more of the natural, unamplified acoustic timbre of the instrument than has been obtainable before.

The magnetoelectric pickup sensor device is based on the phenomenon of magnetoelectricity and use of magnetoelectric composites. Magnetoelectric composites are multi-layer heterostructures, and typically consist of layers of magnetostrictive material, e.g., an amorphous magnetic glass material such as that marketed as METGLAS, galfenol (an iron gallium alloy), and a piezoelectric material, e.g., lead zirconate titanate, lead magnesium niobate, or lead titanate. The magnetostrictive material and piezoelectric material are laminated together in any of various geometric configurations to maximize elastic coupling; an elastic bonding agent is applied between the magnetostrictive material and the piezoelectric material and used to bond the laminate. A magnetostrictive material undergoes bulk deformation, thereby generating strain, as a result of an applied magnetic field. This process is reversible. Likewise, a piezoelectric material undergoes bulk deformation, thereby generating strain, as a reaction to an applied electric field. This process is also reversible. The magnetoelectric effect arises from transfer of stress energy between the magnetostrictive and piezoelectric constituents. When both materials are elastically bonded together, a transducer that generates a voltage response to an applied magnetic field, and vice-versa, is produced. The efficiency of energy transformation in a magnetoelectric composite is defined as the ME coupling coefficient, in V/cm-Oe, or as ME sensitivity, in V/Oe, the latter being more commonly used in describing magnetic field sensors.

Figure 1B:
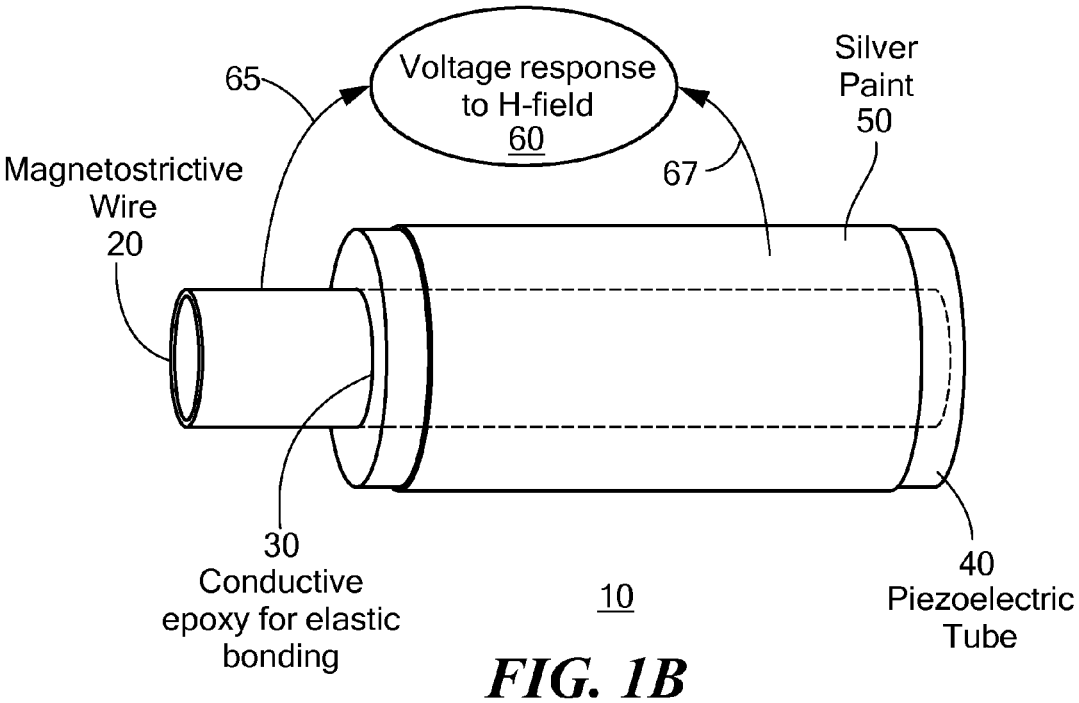
FIG. 1B PRIOR ART
FIG. 1B is a schematic diagram of a magnetoelectric tube sensor (10) of FIG. 1A. The sensor includes magnetostrictive wire 20 (serving as inner electrode), surrounded by elastic, electrically conductive expoxy coating 30, which in turn is surrounded by piezoelectric tube 40, which is coated with silver paint 50 serving as an outer electrode. Voltage response 60 is produced in response to a magnetic field. Outer electrode is connected to electrical lead 65 and inner electrode is connected to electrical lead 67.

Exemplary magnetoelectric sensor devices of different lengths, consisting of piezoelectic lead-zirconate-titanate (PZT) and magnetostrictive nickel-iron (FeNi), were fabricated, and are shown in FIG. 1A and schematically in FIG. 1B. Each device consists of a 0.6 mm diameter FeNi rod inserted into and elastically bonded to a 1 mm outer diameter PZT tube using a conductive epoxy compound as shown in FIG. 1B. The conductive epoxy compound can be, for example, oven-cured at 535° C. for 35 minutes to generate a strong, mechanically elastic bond between piezoelectric and magnetostrictive materials.

Sensitivity of the device is affected by the polarization state of the PZT tube. Sensitivity may be enhanced using a poling process in which 200V DC is applied radially across inner and outer tube electrodes at 100° C. for 30 minutes. The FeNi wire, due to its relatively high permeability, concentrates the magnetic flux of an applied magnetic field, and generates a proportional strain within the wire. This strain is then elastically transferred to the PZT tube, which causes a separation of charge across the conductive FeNi wire, which is effectively an inner electrode, and the outer electrode (consisting of silver paint applied to the exterior of the PZT tube). The charge separation is measured as a voltage response to the applied magnetic field, which may be sent to an amplifier or any other voltage-sensing/processing unit. The device described herein is capable of detecting oscillating magnetic fields greater than 1 nanoTesla in amplitude, and is uniquely suitable for use in musical instruments with magnetic alloy strings since such strings generate small_magnetic perturbations as they vibrate.

The magnetoelectric sensor devices of different lengths (FIG. 1A) of tube sensors were tested at frequencies ranging from 25 Hz through 400 Hz. Numerous types of magnetostrictive materials including hiperco, varieties of galfenol, and iron-nickel alloys were tested. Optimization of material choice depends on the requirements of the end application. The sensitivity of the materials was characterized under static magnetic bias fields from 0-30 Oe, and peak sensitivity under a 10 Oe bias field. For results, see Chen et al., 2011.

Further described herein are ME sensors having three different magnetostrictive wires fabricated into identical geometries of quasi-one-dimensional tube sensor topology. These magnetoelectric wires are galfenol (FG), iron-cobalt-vanadium (FC), and iron-nickel (FN) wires. These were used in the fabrication of three equal length magnetoelectric sensors. Low-frequency sensitivity and noise floor measurements using the sensors were collected, and are presented in Example 2. The sensitivity and noise floor of a quasi-one-dimensional magnetoelectric tube sensor was observed to be dependent on the properties of the magnetostrictive wire.

Iron-nickel wire type demonstrated the highest sensitivity, 3.15 mV/Oe (315 mV/cm-Oe), under no external bias field and also demonstrated the lowest noise floor, <10 nT/√Hz, of all sensors for both bias conditions. Iron-cobalt-vanadium wire and Galfenol types exhibited sensitivity of 1.12 mV/Oe, respectively, under no external bias fields. High sensitivity in the FN wire type device originates from large changes in magnetostriction under low applied magnetic bias field. These results show that use of magnetostrictive wire with large saturation magnetostriction and steep magnetostrictive slope at very low bias fields may be used to improve zero-bias sensitivity and decrease noise floor. The observations are useful for finding ways to eliminate the need for bulky external permanent magnets or electromagnets used to bias magnetoelectric sensors.

Also described herein is a magnetoelectric sensor device containing improvement in tube topology (Example 3). Tube topology is one of many factors including different material combinations, operationa that may be used to increase sensitivity, decrease noise floor, miniaturize device size, eliminate magnetic bias requirement, and extend operational bandwidth (especially at low frequency, below 100 Hz) of a magnetoelectric sensor device (Nan et al., 2010; Fiebig et al., 2005; Wang et al., 201; Zhai et al., 2008; Srinivasan, 2010). The original tube-topology consisted of a magnetostrictive iron-nickel (FeNi) wire inserted and bonded to a piezoelectric lead-zircon-titanate (PZT) tube, using silver epoxy, and with painted on the outer surface with silver (Chen et al., 2011). Application of a magnetic field to this device generated strain in the FeNi wire, which transfered to the tube, and resulted in a separation of charge across the inner and outer surfaces of the tube. In this topology, the only magnetic strain source was the inner wall of the PZT tube.

Figure 7A:
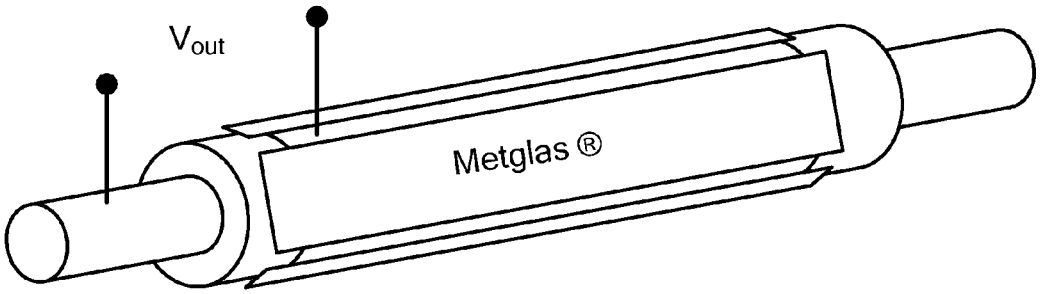
FIG. 7A and FIG. 7B are schematic diagrams of a side-view (FIG. 7A) and a cross-section view (FIG. 7B) of an embodiment of a magnetoelectric magnetic field sensor having METGLAS-enhanced tube-topology.
Figure 7B:
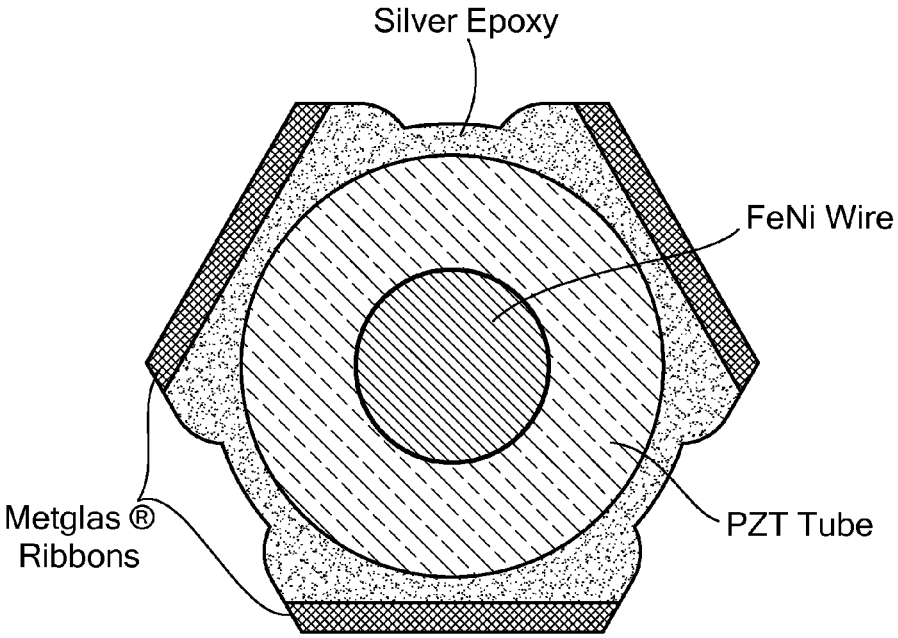
Figure 8A:
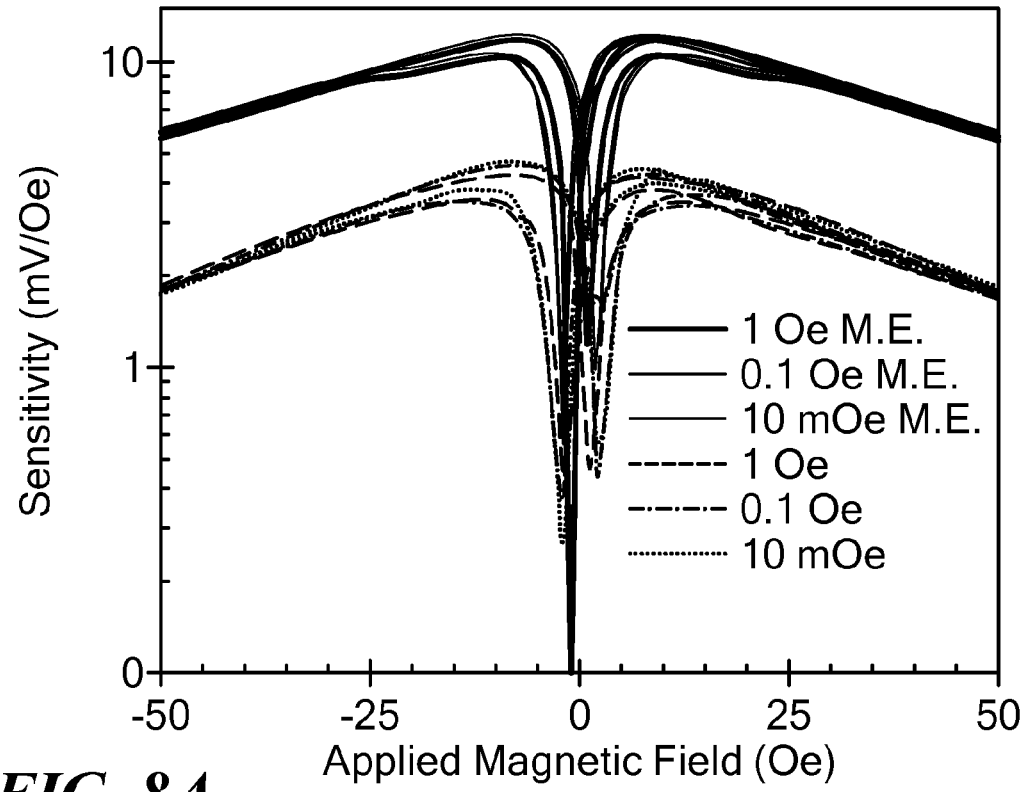
FIG. 8A and FIG. 8B are graphs showing sensitivity comparison between standard (dashed curves) and METGLAS-enhanced (solid curves and denoted with M.E.) devices as a function of applied magnetic bias field.
Figure 8B:
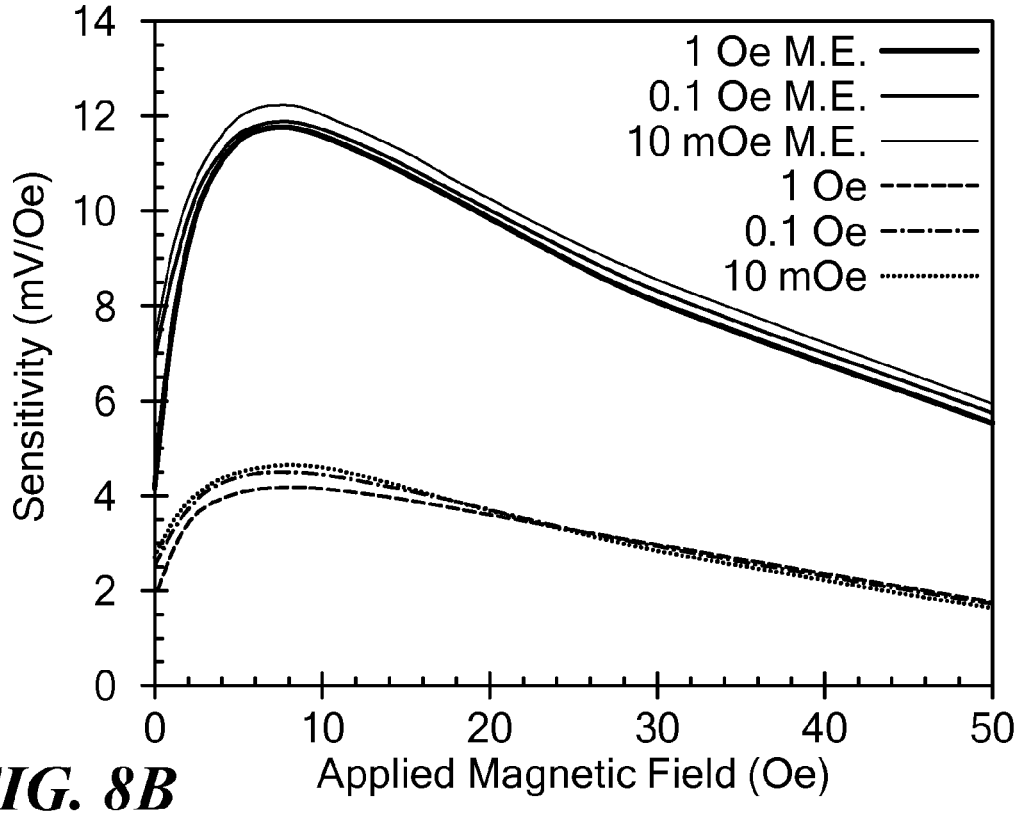

The METGLAS-enhanced topology described herein adds magnetic strain sources to the exterior of the tube to increase the total PZT tube strain which correlates to an increased sensitivity. Instead of a painted silver electrode, three 1 mm by 4 cm strips of METGLAS were uniformly spaced and sinter-bonded to the tube's exterior using a silver conductive epoxy as shown in FIG. 7A. Silver epoxy was built-up underneath the ribbons to promote elastic coupling with the tube as shown in FIG. 7B. As shown in FIGS. 8A-8B, and described in Example 3 below, a 161% increase in zero-bias, and a 160%, increase in optimally biased sensitivity performance, was observed due to addition of METGLAS ribbons.

The ME pickup device of the present invention is adapted for use with a stringed musical instrument, preferably one having strings comprising or consisting of a ferromagnetic material. Examples of such instruments include guitars (all types), banjos, mandolins, ukeleles, pianos, harpsichords, violins, violas, cellos, double basses, and the like. The instrument can have 1, 2, 3, 4, 5, 6, 7, 8, 9, 10, 11, 12, or more strings. The pickup can be either mounted on an already assembled acoustic instrument as an add-on device, or it can be integrated into the design and fabrication of an electro-acoustic instrument. Preferably, the instrument has a soundboard, such as a wooden soundboard, on which one or more ME pickup devices are mounted. For example, a single ME pickup device can be mounted on or near the bridge or saddle that supports the strings on the soundboard, or within a hollow body of the instrument beneath the soundboard, or anywhere on the body of the instrument. Preferably, the ME pickup device is mounted near (e.g., beneath) one or more strings of the instrument, where it is sensitive to magnetic field oscillations induced by the vibrating strings. Two or more ME pickup devices can be mounted on the instrument, either with the same or different orientations to the string axis. In one embodiment, the pickup device is configured as an array of separate ME sensors, one positioned beneath each separate string of the instrument. Preferably, one or more ME sensors are housed in a pickup mount that is adapted for mounting on the body of the instrument, such as on an upper surface of the soundboard. For example, the pickup mount can be configured as having a lower surface which is flat, or has a surface that conforms to the shape of the instrument mounting position, such that optimal transfer of acoustic vibrations from the instrument body or soundboard into the pickup mount or housing is provided, where it is transferred to the ME sensors. Alternatively, ME pickup sensors can be mounted directly to the instrument body or soundboard, such as through an adhesive, or by embedding them into a hole or other space in the instrument body or soundboard.

The orientation of the ME pickup sensors with respect to the string or strings is variable and can be adapted to the design of the instrument or according to the desired acoustic response desired from the instrument. For example, the ME sensor can by cylindrical in form, having a rod of magnetostrictive material at its core aligned with the cylinder axis of the sensor, and this axis can be aligned with (i.e., parallel to) the string axis, perpendicular to the string axis, or have some other orientation. In one embodiment, the ME pickup has a detachable and re-attachable mounting such that the user can vary the placement or orientation of the pickup. Each pickup sensor will generally include two electrical leads (e.g., wires) leading to a signal output adapter or jack on the surface of the instrument, or alternatively leading to a processing and/or wireless transmission module within the instrument. One lead is connected to the inner electrode (magnetostrictive core material) and the other lead is connected to the outer piezoelectric material. Optionally, controls for the sensitivity or tuning of the pickup(s) can be built into the instrument, or provided on a remote device, such as a smart phone or computer.

EXAMPLES

Example 1

Preparation of Magnetoelectric Sensor Devices Having Different Magnetorestrictive Components Three types of magnetoelectric wires galfenol (FG), iron-cobalt-vanadium (FC), and iron-nickel (FN) were used in the fabrication of three equal length magnetoelectric sensors. Each magnetostrictive wire had a diameter of 0.5 mm, and was coupled into a 5 cm long PZT tube having an inner diameter of 0.8 mm and outer diameter of 1 mm. The wire and tube were elastically bonded using a sintered silver-paste epoxy. Wire lengths of 7 cm were used to reduce strain clamping at opposite ends of the active interface, and to provide a contact point for inner electrode. The PZT tube was centered on each wire such that 1 cm of bare wire was exposed at either end of the sensor. Silver paint was applied to the surface of the PZT tube for use as an outer electrode. One copper lead was soldered onto the magnetostrictive wire and a second lead soldered onto the silver paint applied to the exterior of the PZT tube. Each sensor was radially polarized at 200 $V_{DC}$ while heated to 100° C. for 30 minutes prior to testing. Thus, magnetoelectric sensors for detecting strain-induced charge separation—between the outer and inner diameter of the PZT tube were produced. The charge separation was detected radially in a $d_{31}$ mode.

Example 2

Voltage Detection Using Magnetoelectric Sensor Devices

A 15 cm long, 5 cm diameter solenoid, centered inside of a triple-layer Gauss chamber, was part of the experimental set up used for detecting voltage using the magnetoelectric wires described in Example 1. A solenoid coil, instead of a Helmholtz coil, was chosen as the optimal electromagnet for generating a uniform magnetic field region over the length of the tube sensors because the radius of the coil is readily scaled down, reducing power supply requirements, while maintaining longer uniform magnetic field length. Each magnetoelectric sensor was positioned inside the center of the solenoid during measurement such that field was applied axially. Applying magnetic field along the length of the sensor causes axial strain in the wire, and, via elastic coupling, produces axial strain in the PZT tube. Voltage is detected radially across the PZT tube due to axial strain, resulting in a $d_{31}$ operational mode. The Gauss chamber effectively shielded the measurement region from stray external magnetic fields and was electrically grounded to double as a Faraday cage. The solenoid was used to generate both AC and DC magnetic fields, and was calibrated using a Lakeshore 421 Gaussmeter. A 25 Hz, 1 mOe RMS AC magnetic field was utilized as the reference test field for all measurements. An external DC magnetic bias field was superimposed on the test field, and was swept through the values of 0, 1, 2, 3, 5, 7.5, 10, 15, 20, 30, and 50 Oe, throughout the following sequence: 0 Oe, +50 Oe, −50 Oe, and +50 Oe. This sweep pattern was used to collect hysteresis behavior of the sensors and to eliminate any measurement error associated with only capturing virgin curve data. Due to relatively low coercivity of each magnetostrictive wire, the sweep pattern effectively erased any effects of magnetic fields applied before.

Copper leads of each sensor were directly connected to the input of a Stanford Research Systems SR770 FFT Analyzer, and voltage spectral density (VSD) sweep measurements, in units of Vrms/√Hz, were captured from 1 thru 50 Hz. The measurement procedure consisted of capturing sensor response as a function of magnetic bias field using an AMREL PD30-1.2D DC programmable power supply to generate magnetic bias field, and using the SR770 to capture 1000 linearly-averaged VSD measurements at each step. Sensitivity (in V/Oe) and magnetic spectral density (in T/√Hz) were calculated from the raw data.

Figure 3:
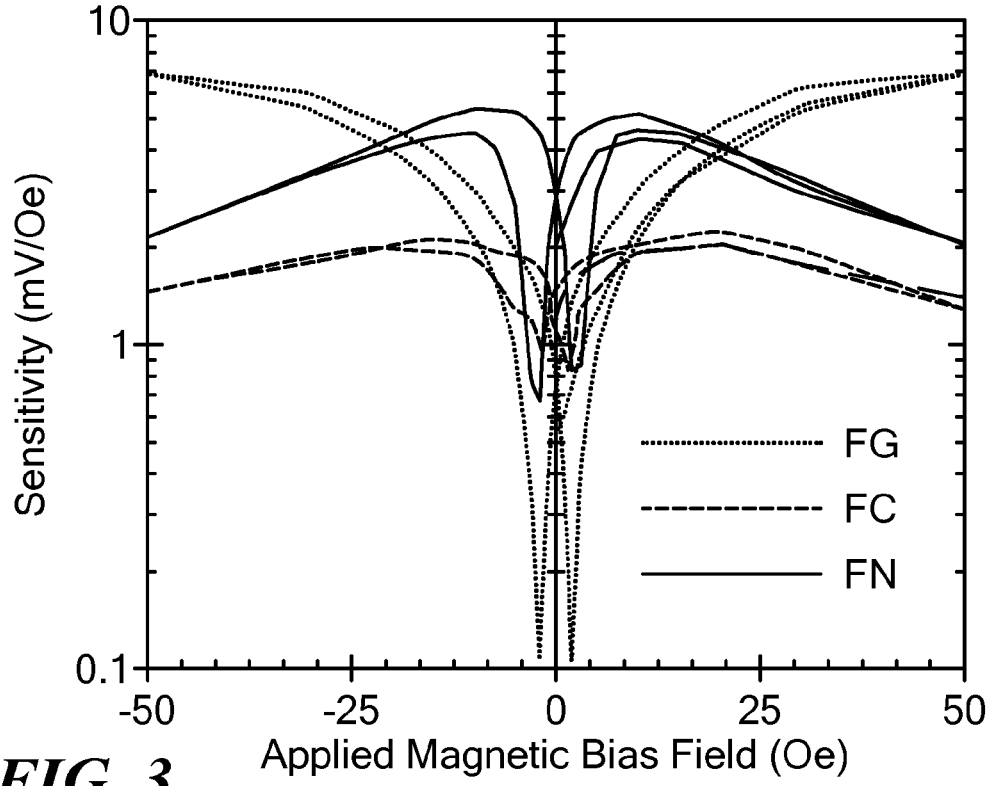
FIG. 3 is a graph of sensitivity of a magnetoelectric device as described herein plotted as a function of swept bipolar applied magnetic bias field. Sensor FN (iron-nickel; solid curves) exhibited highest sensitivity under low (<20 Oe) and zero-biased conditions, and sensor FG (Gelfenol; dotted curves) exhibited higher sensitivity at bias fields >20 Oe.

Sensitivity behavior of the magnetoelectric tube sensors containing three different magnetostrictive wires are shown in FIG. 3. Hysteretic effects exhibiting butterfly-shaped sensitivity curves were observed in the quasi-one-dimensional tube topology sensors. For sensors FC and FN, sensitivity was observed to initially increase, peak at 20 and 10 Oe respectively, then decrease as magnetic bias field increased from 0 to +50 Oe during virgin curve. For sensor FG, sensitivity was observed to continually increase along with bias field from 0 to +50 Oe. All three sensors exhibited similar behavior as bias field was reduced from +50 to 0 Oe in that sensitivity mirrored the shape of the virgin curve but at a higher value, exhibiting hysteresis.

As the bias field polarity was reversed and swept from 0 to −50 Oe, sensitivity became minimized for each sensor at −2 Oe, indicating that each magnetostrictive wire has a coercivity of—about_2 Oe in this geometrical configuration. More importantly, this indicates that sensors can exhibit an enhanced zero-external-bias sensitivity when a magnetic field is temporarily applied and then removed, enabling the wire to exhibit enhanced magnetostriction under the influence of its own internal remnant magnetization. Minimum sensitivity values for FG, FC, and FN sensors were measured at −2 Oe to be 105, 841, and 672 μV/Oe, respectively. As bias field swept from −2 to −50 Oe, sensitivity was shown to increase with field, which is consistent with the magnetic hysteresis loop. Finally, as bias field swept from −50 to +50 Oe, the same trend was exhibited, in reverse. When optimally biased at 50, 15, and 10 Oe, sensors FG, FC, and FN exhibited sensitivity values of 6.88, 2.12, and 5.36 mV/Oe, respectively. At zero external-bias, sensors FG, FC, and FN exhibited sensitivity values of 0.843, 1.12, and 3.15 mV/Oe, respectively.

Figure 4:
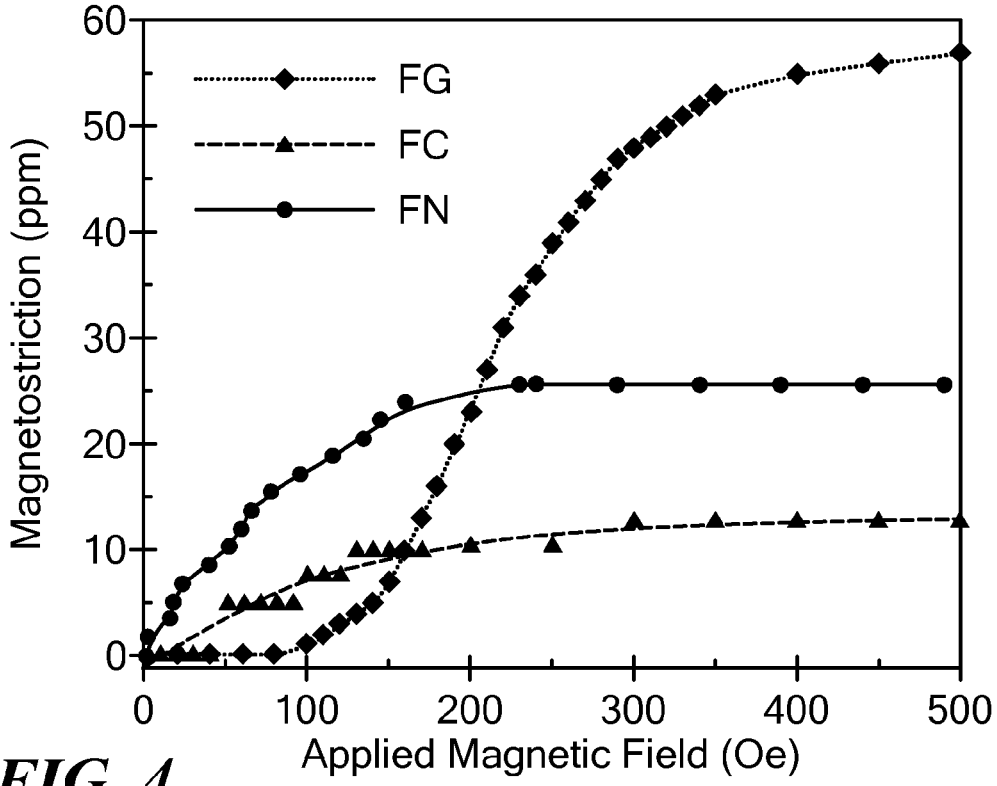
FIG. 4 is a graph of magnetostriction measured as a function of applied magnetic field for FG (diamond), FC (iron-cobalt-vanadium; triangle), and FN (circle) magnetoelectric material.

Magnetostriction data were collected for each wire type using a Vishay P3 strain meter and is shown in FIG. 4. Strain, in parts-per-million (ppm) was measured as a function of applied magnetic field from 0 to 500 Oe. Due to the small sample size of the wire relative to the strain gauge size, correction factors were used. Peak slope of magnetostriction occurred under very low (<20 Oe) applied magnetic fields for samples FC and FN, whereas it occurred at 200 Oe for sample FG. These data are in good agreement with the sensitivity curves shown in FIG. 4, indicating that a maximum in dλ/dH corresponds with peak sensitivity for sensors FC and FN at 15 and 10 Oe, respectively. It also validates the behavior of FG in that sensitivity increases along with applied field, up to 50 Oe, due to the wire undergoing steady increase in dλ/dH from 0 to 50 Oe.

Figure 5:
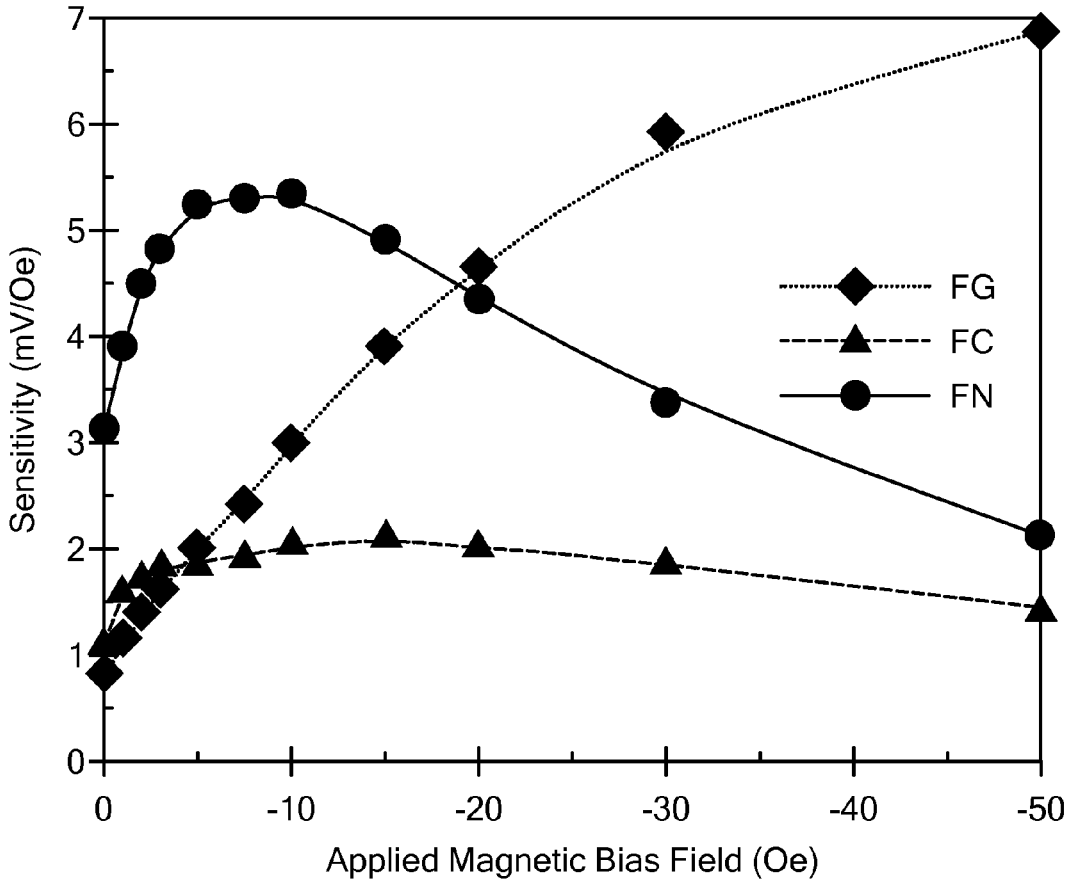
FIG. 5 is a graph of peak sensitivity measurements of magnetoelectric devices having FG (diamond), FC (triangle), or FN (circle) magnetoelectric material. Magnetic field was applied starting at −50 Oe and swept towards zero. The curves display peak performance for the devices.

FIG. 5 shows peak sensitivity curves of each sensor as a function of external bias field and captured as magnetic bias magnitude decreased from −50 Oe to 0. In this way, enhancement to sensitivity was observed relating to hysteresis effects. This effect relates to hysteresis through net alignment of magnetic dipoles in the wire. In a demagnetized state, randomly aligned magnetic dipoles cause a lesser net strain due to destructive interference of magnetostriction, resulting in lower strain on the PZT tube, and ultimately a lower voltage response. As the dipole moments become aligned under influence of an externally applied magnetic field, magnetos trictively-induced strain interferes constructively and ultimately results in higher voltage response. Magnetic hysteresis influences not only the degree to which an applied magnetic field further aligns or misaligns dipoles in the wire, but also the field dependence of magnetostriction. This effect is shown in the butterfly shaped curves of FIG. 3. FIG. 5 emphasizes the peak sensitivity curve, which is captured after magnetic dipole alignment has been established. The combination of hysteretic effects and the derivative of magnetostriction determines the sensitivity curve of a magnetoelectric magnetic field sensor. It is postulated that the remnant magnetization of the magnetostrictive wire can be engineered to emulate the effective external bias field at which the maximum of the derivative of the magnetostriction curve occurs. Doing so would enable optimal sensitivity performance under zero external magnetic bias.

Figure 6A:
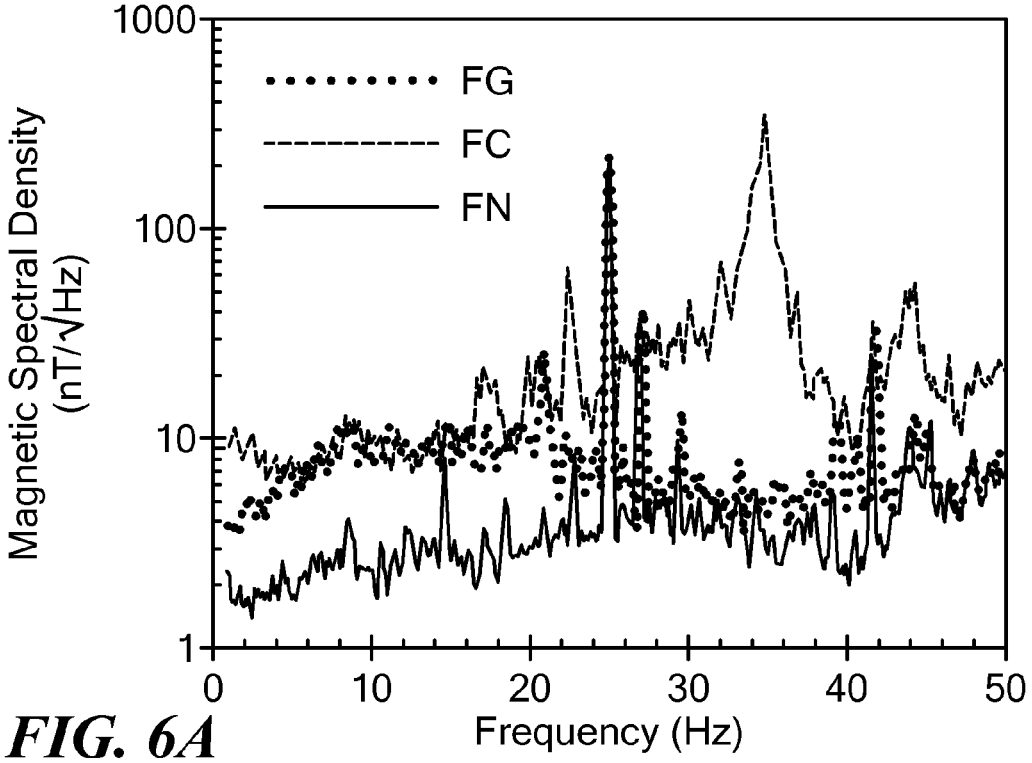
FIG. 6A and FIG. 6B are graphs showing magnetic spectral density plots of magnetoelectric devices having FG (diamond), FC (triangle), or FN (circle) magnetoelectric material, under optimally biased (FIG. 6A) and zero-biased (FIG. 5B) conditions, respectively. All devices exhibit noise floor in the nanoTesla range at low frequency. A magnetic test field of 25 Hz, and 1 mOe (100 nT) was applied during the measurement.
Figure 6B:
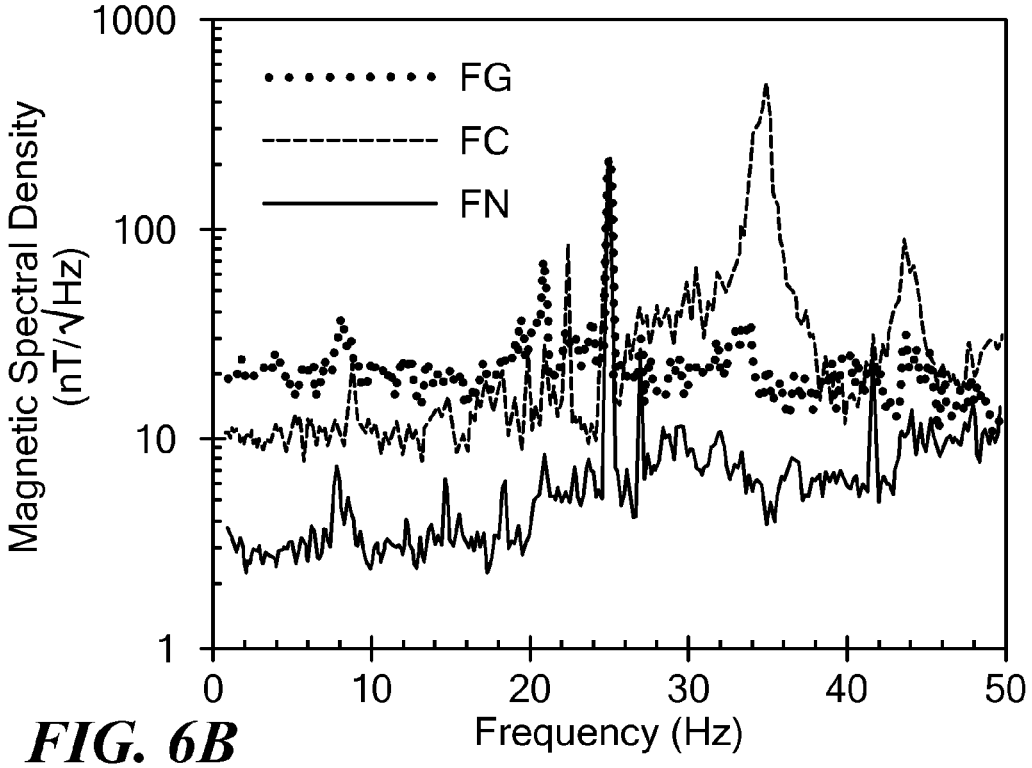

Magnetic spectral density response demonstrating the noise floor of each sensor is shown in FIGS. 6A-6B. Frequency sweeps from 1 through 50 Hz were averaged and captured while applying a 25 Hz, 1 mOe test field for reference. Both optimally biased (FG @50 Oe, FC @15 Oe, and FN @10 Oe), and zero-bias configurations indicate low frequency noise floor in the nanoTesla range for all sensors. Sensor FN exhibited the lowest 1-Hz noise floor of all three devices at 2.3 nT/√Hz (1.13 nT accounting for bandwidth) when biased with a 10 Oe H-field. Spurious noise peaks were detected by each sensor and considered to be background electromagnetic noise caused by various external sources such as electronics, fans, building systems, traffic, etc. Sensor FC has a unique, repeatable noise signature at 34 Hz, which does not occur with FN and FG sensors and is considered to be intrinsic to the device. In a zero-biased state, FN exhibited a noise floor <10 nT/√Hz from 1 thru 50 Hz, which is lowest of the three devices.

Example 3

METGLAS-Enhanced Tube-Topology Magnetoelectric Magnetic Field Sensor

Improvement in the topology of a magnatoelectric tube sensor device is one way of increasing the sensitivity, decreasing noise floor, miniaturizeing size, eliminating magnetic bias requirement, and extending the operational bandwidth (especially at low frequency, below 100 Hz) of the device. Significant enhancement in sensitivity was realized by the addition of METGLAS ribbons to the tube-topology as described below.

The basic tube-topology, described Chen et al., 2011, consists of a magnetostrictive iron-nickel (FeNi) wire inserted and bonded, using silver epoxy, to a piezoelectric lead-zircon-titanate (PZT) tube, with a silver painted outer surface. Applying a magnetic field to this device generates strain in the FeNi wire, which transfers to the tube, and results in a separation of charge across the inner and outer surfaces of the tube. In this topology, the only magnetic strain source is along the inner wall of the PZT tube. The METGLAS-enhanced topology adds magnetic strain sources to the exterior of the tube to increase the total PZT tube strain which correlates to an increased sensitivity.

Instead of a painted silver electrode as used in an earlier design (Chen et al., 2011), three 1 mm by 4 cm strips of METGLAS were uniformly spaced and sinter-bonded to the tube's exterior using a silver conductive epoxy as shown in FIGS. 7A and 7B. Silver epoxy was built-up underneath the ribbons to promote elastic coupling with the tube as shown in FIG. 7B. The device was poled according to Chen et al 2011, and tested.

A 5 cm METGLAS-enhanced tube sensor was compared to a standard 5 cm tube sensor, representing the control, fabricated and poled under identical conditions. Sensitivity was characterized using a 25 Hz test field at amplitudes of 0.01, 0.1 and 1 Oe RMS as a function of applied static magnetic bias field in the range of −50 to 50 Oe. Full loops of sensitivity vs. bipolar magnetic field sweeps are shown in FIG. 8A and peak sensitivity in FIG. 8B. Sensitivity was observed to generally increase with decrease the test field amplitude. For a test field of 10 mOe, zero bias and optimally biased (7.5 Oe) measurements of the control device were found to be 2.84 and 4.74 mV/Oe, respectively. Zero-biased and 7.5 Oe biased sensitivity measurements were observed to be 7.43 and 12.3 mV/Oe, respectively, for the METGLAS-enhanced sensor. This represents a significant 161% and 160% increase in zero-bias and optimally biased sensitivity performance due to addition of METGLAS ribbons.

These results obtained demonstrated that introduction of a magnetic strain source to the exterior of the PZT tube enhances the total strain applied to tube, causing a greater separation of charge across its thickness, and ultimately increases device sensitivity. Here, METGLAS was chosen due to its availability and its similar magnetostriction behavior to FeNi.

Example 4

Magnetoelectric Pickup for a Musical Instrument

A magnetoelectric pickup, made according to any of the examples described above, is assembled into an electroacoustic guitar as follows. The magnetoelectric pickup is mounted under the strings of the instrument such that the magnetorestrictive material of the magnetoelectric pickup senses vibrations corresponding to those produced by the vibrating strings of the instrument. Because the magnetorestrictive material is capable of deforming structurally and generating strain, and because the magnetorestrictive material is surrounded by a piezoelectric material, the strain generates a proportional voltage response.

Figure 2A:
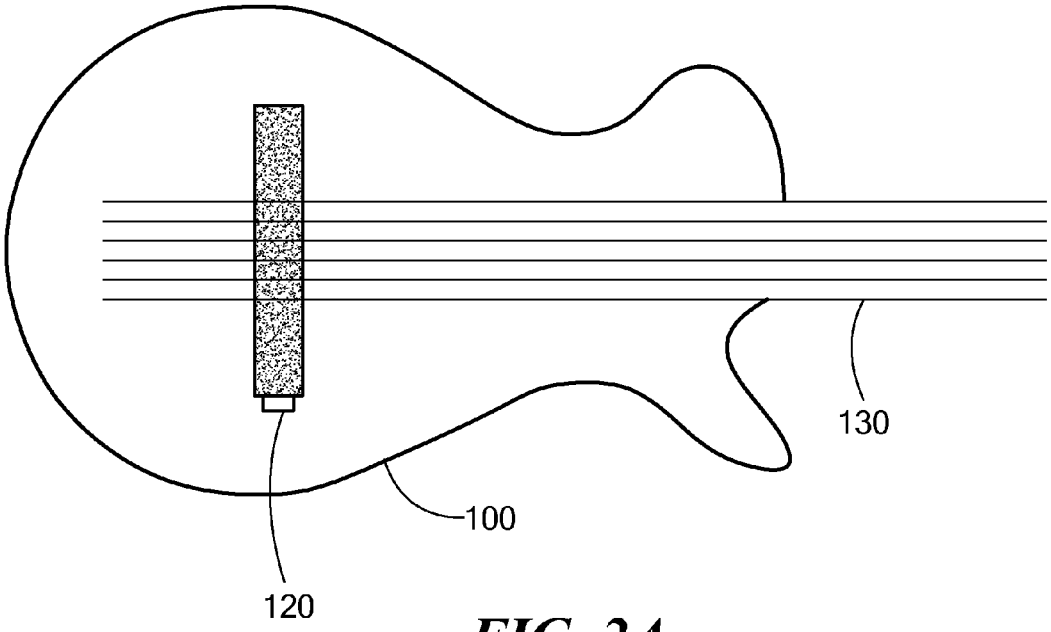
FIG. 2A is a schematic diagram of an exemplary string musical instrument, an electrically amplified acoustic guitar, showing a magnetoelectric pickup mount 110, which is mounted beneath strings 130 of the instrument on instrument body 100. The magnetoelectric pickup is contained within a pickup mount (pickup and mount shown as assembly 120). The pickup mount transfers vibrations from the instrument body to the magnetoelectric pickups, and the pickups also sense magnetic field oscillations produced by the vibrating strings themselves.
Figure 2B:
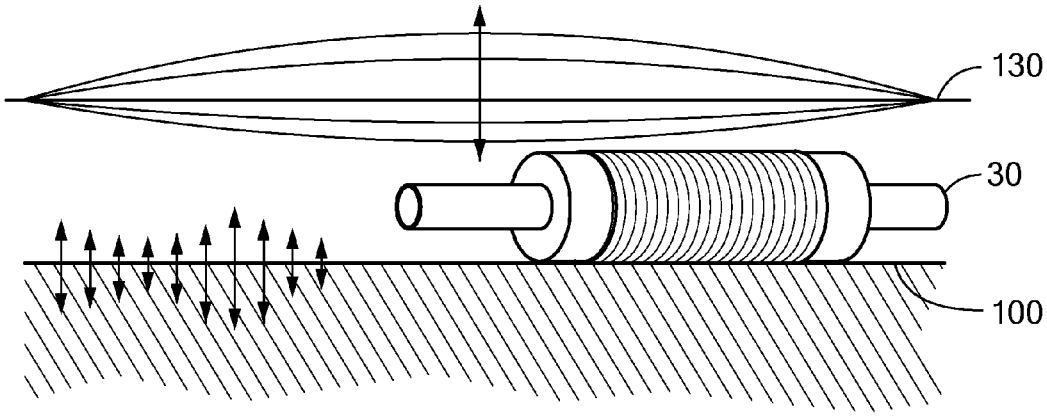
FIG. 2B is a schematic diagram showing a side view of an embodiment of the invention having magnetoelectric pickup 30 mounted on soundboard 100 in a parallel orientation to vibrating string 120.
Figure 2C:
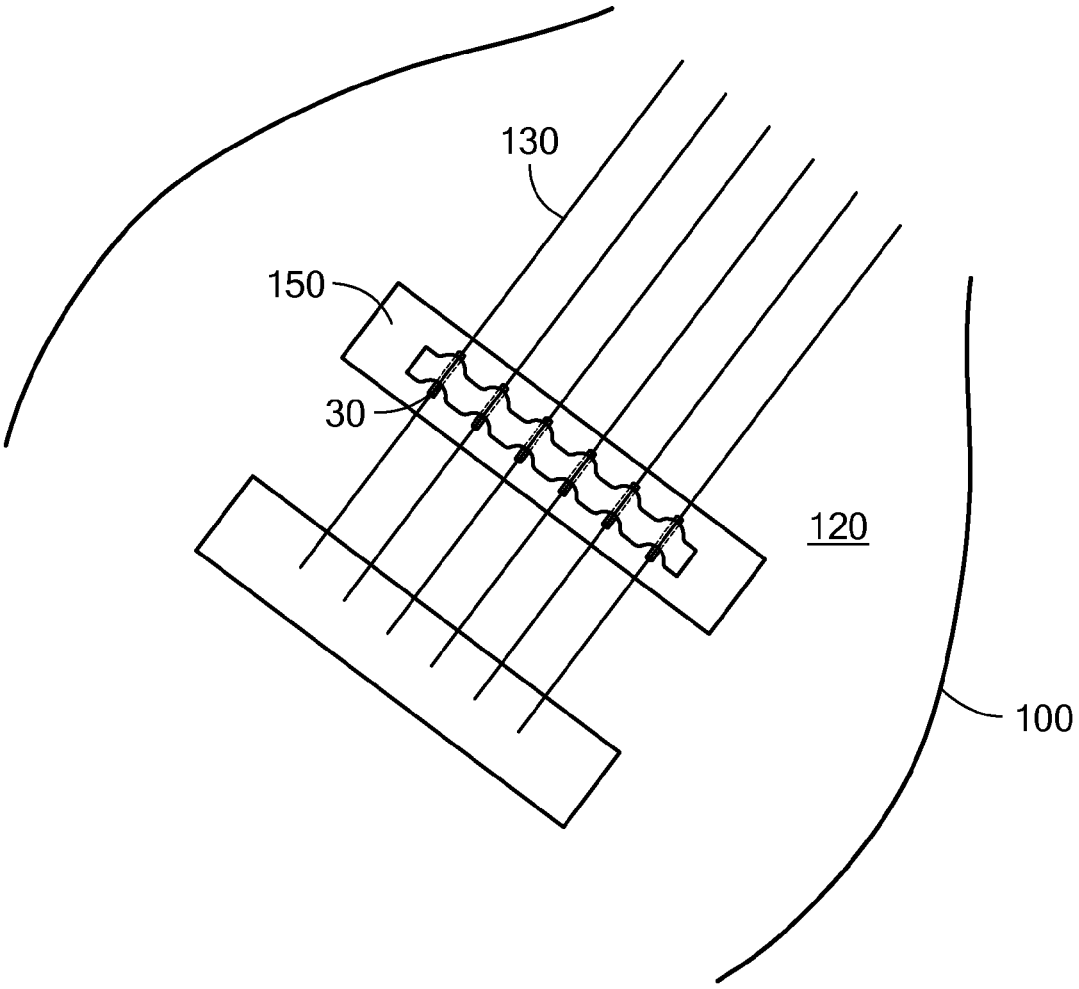
FIG. 2C shows a close-up of another embodiment having individual pickups, one aligned with each string, mounted in a pickup mount (150).

A single magnetoelectric pickup extends under all the strings of the instrument, as shown in FIG. 2A. The pickup has a screw so that the height of the pickup with respect to the strings is adjustable. The closer the pickup is to a string, the stronger the signal.

REFERENCES

Chen, Y., Fitchorov, T., Vittoria, C., and Harris, V. G. *Applied Physics Letters* 97, 052502 (2010)

Dong, S., Zhai, Xing, Z., Li, J.-F., and Viehland, D. *Applied Physics Letters* 86, 102901 (2005)

Chen, Y., Gillette, S. M., Fitchorov, T., Jiang, L., Hao, H., Li, J., Gao, X., Geiler, A., Vittoria, C., and Harris, V. G. *Applied Physics Letters* 99, 042505 (2011)

Fiebig, M. Journal of Physics D: *Applied Physics* 38, R123 (2005)

Fitchorov, T., Chen, Y., Hu, B., Gillette, S. M., Geiler, A., Vittoria, C., and Harris, V. G. *Journal of Applied Physics* 110, 123916 (2011)

Fitchorov, T., Yajie, C., Liping, J., Guangrui, Z., Zengqi, Z., Vittoria, C., and Harris, V. G. *Magnetics, IEEE Transactions* 47, 4050 (2011)

Geiler, A. L., Gillette, S. M., Chen, Y., Wang, J., Chen, Z., Yoon, S. D., He, P., Gao, J., Vittoria, C., and Harris, V. G. *Applied Physics Letters* 96, 053508 (2010)

Gillette, S. M., Geiler, A. L., Gray, D., Viehland, D., Vittoria, C., and Harris, V. G., *Magnetics Letters, IEEE* 2, 2500104 (2011)

Lenz, J and Edelstein, A. S. Sensors Journal, IEEE 6, 631 (2006)

Li, M., Berry, D., Das, J., Gray, D., Li, J., and Viehland, D. *Journal of the American Ceramic Society* 94, 3738 (2011)

Ma, J., Hu, J., Li, Z., and Nan, C.-W. *Advanced Materials* 23, 1062 (2011)

Nan, C.-W., Bichurin, M. I., Shuxiang, D., Viehland, D., and Srinivasan, G. *Journal of Applied Physics* 103, 031101 (2008)

Spaldin, N. A. and Fiebig, M. *Science* 309, 391 (2005)

Srinivasan, G., Magnetoelectric Composites. *Annual Review of Materials Research* 40(1): p. 153-178 (2010)

Wang, Y., et al., Multiferroic magnetoelectric composite nanostructures. *NPG Asia Mater,* 2: p. 61-68 (2010)

Zhai, J., et al., Magnetoelectric Laminate Composites: An Overview. *Journal of the American Ceramic Society,* 91(2): p. 351-358 (2008)

What is claimed is:

1. A magnetoelectric pickup for a musical string instrument, the pickup comprising:

a magnetoelectric sensor comprising:

an inner electrode core comprising a magnetostrictive material;

a piezoelectric coating material surrounding the inner electrode core at least in part; and an outer electrode layer applied to an outer surface of the piezoelectric coating material comprising either a conductive material or a conductive magnetostrictive material;

wherein the piezoelectric coating material is elastically bonded to the inner electrode core; and a pickup mount comprising said magnetoelectric sensor and adapted to mount on the body of a musical string instrument;

wherein an oscillating magnetic field from a vibrating ferromagnetic string in the vicinity of the pickup element produces a voltage output signal between said inner and outer electrodes.

2. The pickup of claim 1, wherein the inner electrode core comprises a magnetostrictive material selected from the group consisting of: iron-nickel alloys, iron-cobalt-vanadium alloys, galfenol, amorphous magnetic glass, and combinations thereof.

3. The pickup of claim 1, wherein the magnetostrictive material is galfenol, and the sensitivity at an external bias of 50 Oe is at least about 3.5 mV/Oe.

4. The pickup of claim 2, wherein the magnetostrictive material is galfenol or iron-cobalt-vanadium alloy, and the sensitivity at zero external bias is at least about 0.4 mV/Oe.

5. The pickup of claim 2, wherein the magnetostrictive material is iron-cobalt-vanadium alloy, and the sensitivity at 15 Oe is at least about 1.0 mV/Oe.

6. The pickup of claim 2, wherein the magnetostrictive material is iron-nickel, and the sensitivity at 10 Oe is, at least about 2.5 mV/Oe.

7. The pickup of claim 1, wherein the piezoelectric coating material comprises lead zirconate titanate and the outer electrode layer comprises Ag.

8. The pickup of claim 1, wherein the outer electrode layer comprises at least one strip of a ferromagnetic amorphous metal alloy.

9. The pickup of claim 8, wherein the ferromagnetic amorphous metal alloy is an amorphous magnetic glass.

10. The pickup of claim 8, wherein two or more strips of the ferromagnetic amorphous metal alloy are uniformly spaced.

11. The pickup of claim 8, wherein the at least one strip of the ferromagnetic amorphous metal alloy is sinter-bonded to the tube's exterior using a silver conductive epoxy.

12. The pickup of claim 1, wherein the outer electrode layer is a conductive magnetostrictive jacket that serves both as outer electrode and as a uniform outer magnetic strain source.

13. The pickup of claim 1, wherein the zero-biased sensitivity is at least about 4.0 mV/Oe.

14. The pickup of claim 1, wherein the 7.5 Oe biased sensitivity is at least about 7.0 mV/Oe.

15. A method of detecting acoustic vibrations in a musical string instrument, the method comprising detecting charge separation between the inner and outer electrodes of the magnetoelectric pickup of claim 1.

16. The method of claim 15, wherein a voltage output signal from the magnetoelectric pickup replicates both a vibration emanating from a string of the instrument and an acoustic vibration emanating from a portion of the body of the instrument.

17. The magnetoelectric pickup of claim 1 that is cylindrical in form and less than 1 mm in diameter.

18. A musical string instrument comprising the magnetoelectric pickup of claim 1.

19. The instrument of claim 18 that is selected from the group consisting of guitars. banjos, mandolins, ukeleles, pianos, harpsichords, violins, violas, cellos, and double basses.

20. The instrument of claim 18, wherein the pickup is mounted on the soundboard of the instrument beneath the strings.

21. The magnetoelectric pickup of claim 1, wherein an acoustic vibration emanating from a body of the instrument further contributes to said voltage output signal.

22. The magnetoelectric pickup of claim 1, wherein the vibrating string does not contact the pickup element.

23. The magnetoelectric pickup of claim 1, wherein the inner electrode core is aligned parallel to the ferromagnetic string.

* * * * *